US009615634B2

(12) United States Patent
Kaltenrieder et al.

(10) Patent No.: US 9,615,634 B2
(45) Date of Patent: Apr. 11, 2017

(54) CLASP FOR WATCH WRISTLET OR BELT

(71) Applicant: Omega SA, Bienne (CH)

(72) Inventors: Cédric Kaltenrieder, Bienne (CH); Rocco Catanese, Bienne (CH)

(73) Assignee: Omega SA, Bienne (CH)

( * ) Notice: Subject to any disclaimer, the term of this patent is extended or adjusted under 35 U.S.C. 154(b) by 54 days.

(21) Appl. No.: 14/363,960

(22) PCT Filed: Sep. 17, 2012

(86) PCT No.: PCT/EP2012/068255
§ 371 (c)(1),
(2) Date: Jun. 9, 2014

(87) PCT Pub. No.: WO2013/083305
PCT Pub. Date: Jun. 13, 2013

(65) Prior Publication Data

US 2014/0352119 A1 Dec. 4, 2014

(30) Foreign Application Priority Data

Dec. 9, 2011 (EP) ..... 11192833

(51) Int. Cl.
*A44C 5/18* (2006.01)
*A44B 17/00* (2006.01)
(Continued)

(52) U.S. Cl.
CPC ..... *A44B 17/0017* (2013.01); *A44C 5/24* (2013.01); *A44C 5/246* (2013.01); *A41F 9/025* (2013.01); *Y10T 24/2155* (2015.01)

(58) Field of Classification Search
CPC ..... A44C 5/24; A44C 5/246; A44B 17/0017
(Continued)

(56) References Cited

U.S. PATENT DOCUMENTS 6,944,916 B2 * 9/2005 Kawagoe ..... A44C 5/185 24/265 WS
8,001,658 B2 * 8/2011 Christian ..... A44C 5/246 24/265 WS
(Continued)

FOREIGN PATENT DOCUMENTS

CH 696 697 A5 10/2007
CH EP 2248437 A1 * 11/2010 ..... A44C 5/22
(Continued)

OTHER PUBLICATIONS

EP 2361523 Machine Translation.*
(Continued)

*Primary Examiner* — Robert J Sandy
*Assistant Examiner* — Jason W San
(74) *Attorney, Agent, or Firm* — Oblon, McClelland, Maier & Neustadt, L.L.P.

(57) ABSTRACT

Clasp for a watch bracelet comprising a cover connected on a first side to a first bracelet strand and on a second side to a second bracelet strand, a connecting means being inserted between the second bracelet strand and the cover of the clasp, the connecting means comprising an end link sliding along a longitudinal direction of the clasp between a first position in which the end link is at least partially engaged in the cover of the clasp, and a second position in which the end link is disengaged from the cover of the link, the end link comprising a push-button which, when pressed, causes a toothed element to change from a first position, in which the toothed element is in mesh with a rack toothing integral with the cover of the clasp, to a second position, in which the toothed element is released from the engagement thereof with the rack toothing; the clasp being characterized in that the end link includes a housing in which there is arranged at
(Continued)

least one spring, the spring being covered by the push-button.

14 Claims, 4 Drawing Sheets

(51) Int. Cl.
*A44C 5/24* (2006.01)
*A41F 9/02* (2006.01)

(58) Field of Classification Search
USPC ..... 24/71 J, 70 J, 265 WS
See application file for complete search history.

(56) References Cited

U.S. PATENT DOCUMENTS 8,196,267 B2 * 6/2012 Nalley ..... A44C 5/24
24/265 WS
2005/0262668 A1 * 12/2005 Ho ..... A44C 5/24
24/71 J
2008/0083101 A1 * 4/2008 Christian ..... A44C 5/246
24/71 J
2009/0049667 A1 * 2/2009 Takahashi ..... A44C 5/243
24/71 J

FOREIGN PATENT DOCUMENTS

CH EP 2361523 A1 * 8/2011 ..... A44C 5/246
CH 704335 A1 * 7/2012 ..... A44C 5/246
CH EP 2767184 A1 * 8/2014 ..... A44C 5/24
CH EP 2868222 A1 * 5/2015 ..... A44C 5/24
EP 2 361 523 A1 8/2011
JP 51-18168 U 2/1976
JP 2000-279217 A 10/2000

OTHER PUBLICATIONS

EP 2248437 Machine Translation.*
International Search Report issued in corresponding application PCT/EP2012/068255, completed Oct. 22, 2012 and mailed Oct. 30, 2012.

* cited by examiner

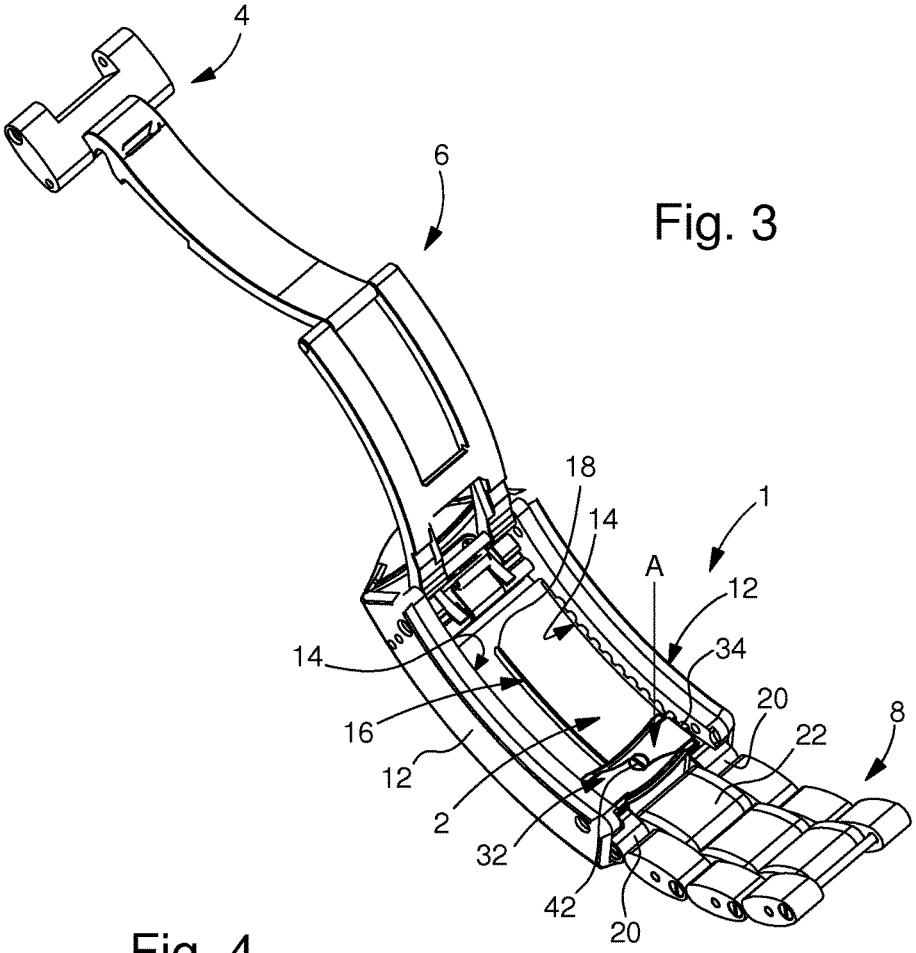
Fig. 3
Fig. 4
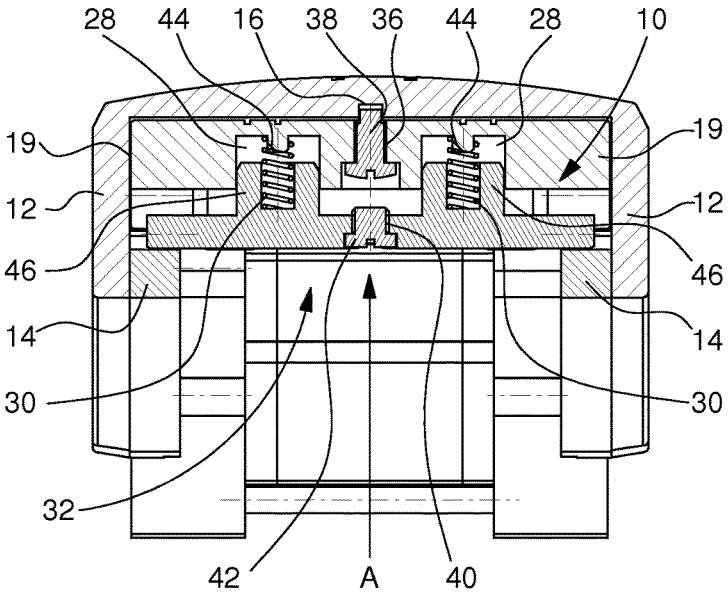

Fig. 5
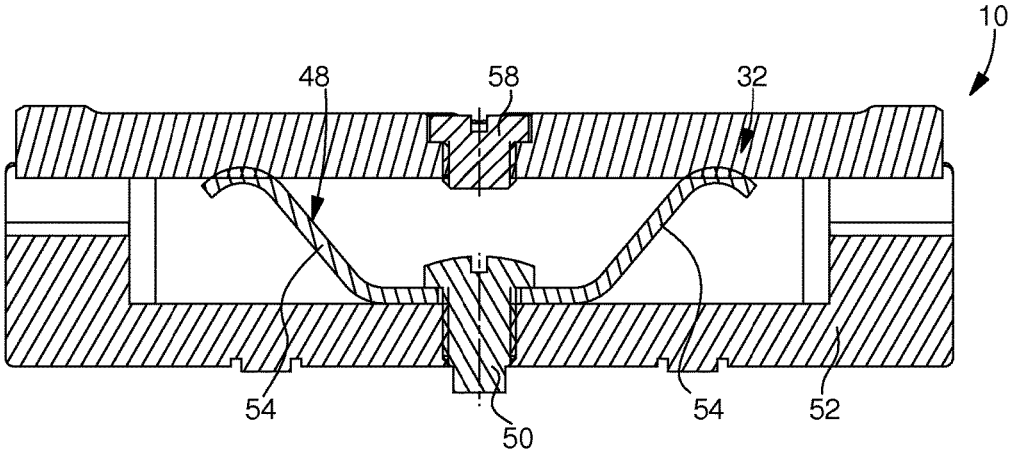
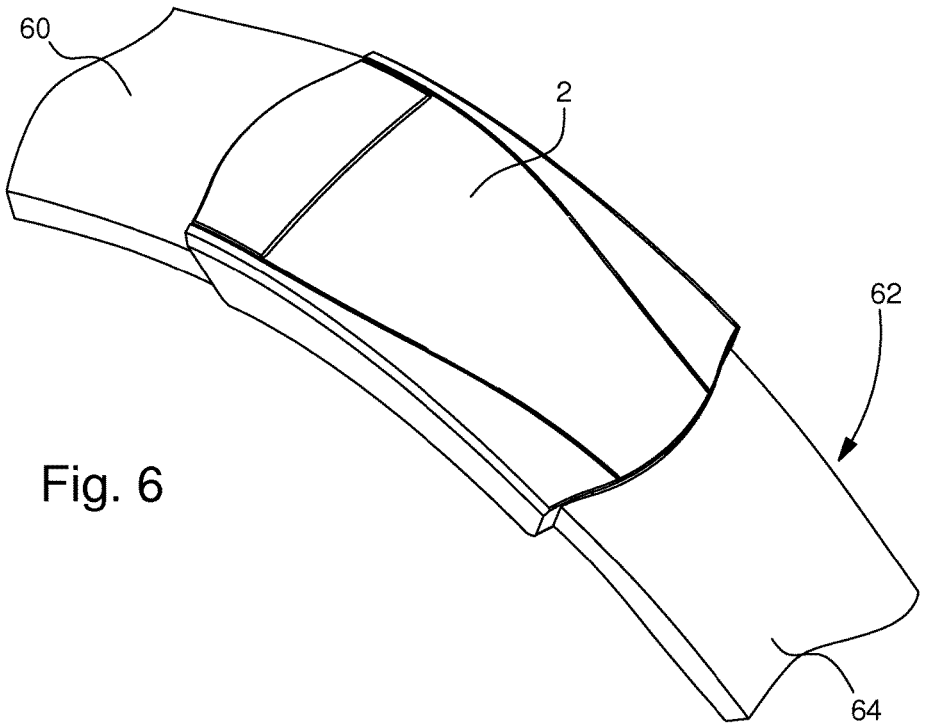
Fig. 6

CLASP FOR WATCH WRISTLET OR BELT

This is a National Phase Application in the United States of International Patent Application No. PCT/EP2012/068255 filed Sep. 17, 2012, which claims priority on European Patent Application No. 11192833.9, filed Dec. 9, 2011. The entire disclosures of the above patent applications are hereby incorporated by reference.

The present invention concerns a clasp for a watch bracelet or wristlet or for a belt. More specifically, the present invention concerns a clasp for a watch bracelet or a belt comprising a means of finely adjusting the length of the bracelet or belt.

Clasps comprising a means of finely adjusting the length of a watch bracelet are already known in the state of the art. A clasp with fine adjustment of a bracelet length means a clasp which allows adjustment of the bracelet length over a short length for the best possible fit to optimise the comfort of the person wearing the watch. These clasps usually include an end link via which one of the bracelet strands is connected to the clasp cover. The end link is able to slide in a longitudinal direction of the clasp between a first "in" position in which it is housed in the clasp cover and a second "out" position in which it is released from the clasp. Consequently, the available length for fine adjustment is determined by the travel of the end link between its first and second positions. The end link cooperates via a toothed element with a rack toothing to index the end link position. By way of example, the rack may be integral with the clasp cover and the toothed element may be carried by the end link. It is also possible to envisage switching the position of the rack toothing and the toothed element.

When the toothed element is meshed with the rack toothing, the end link is immobilised. Elastic uncoupling means are provided to disengage the toothed element from its mesh with the rack toothing. The elastic means usually offers a short uncoupling travel. Due to the short travel of the elastic uncoupling means, the teeth of the rack toothing cannot be very high. Consequently, the locking strength between the toothed element and the rack toothing is relatively low, so that the position of the end link can easily be de-indexed, for example by pulling or pushing the end link, which is unacceptable. Further, it is easily understood that, the smaller the teeth of the rack toothing, the higher the manufacturing tolerances will be, which increases the cost price of this type of clasp.

It is an object of the present invention to overcome the aforementioned drawbacks, in addition to others, by providing a clasp for finely adjusting the length of a watch bracelet or of a belt which makes it possible to maintain the bracelet or belt length adjustment without any risk of inadvertent loss.

The invention therefore concerns a clasp for a watch bracelet or a belt comprising a cover connected on a first side to a first bracelet or belt strand and on a second side to a second bracelet or belt strand, a connecting means being inserted between the second bracelet or belt strand and the clasp cover, said connecting means comprising an end link sliding along a longitudinal direction of the clasp between a first position in which the end link is at least partially engaged in the clasp cover, and a second position in which the end link is disengaged from the clasp cover, the end link comprising a push-button which, when pressed, causes a toothed element to change from a first position, in which the toothed element is in mesh with a rack toothing integral with the clasp cover, to a second position, in which the toothed element is released from its engagement with the rack toothing; the clasp being characterized in that the end link includes a housing inside which there is arranged at least one spring, said spring being covered by the push-button.

As a result of these features, the present invention provides a clasp for a watch bracelet or a belt wherein the disengagement between the toothed element and the rack toothing is controlled by at least one spring. This spring provides the push-button with a substantial travel, said travel being determined only by the length of the spring. Since the push-button directly controls the change of the toothed element from its first position, in which it is meshed with the rack toothing, to its second position, in which it is released from its engagement with the rack toothing, the travel of the toothed element between its two end positions is also greater. Consequently, the teeth of the rack toothing may be made higher than is usually the case in the state of the art and thus the spaces between the teeth can be deeper. The locking force between the toothed element and the rack toothing is thus higher, so that the position of the end link cannot be de-indexed, unless the clasp is destroyed. Further, since the teeth of the rack toothing are higher, the manufacturing tolerances are less strict, which makes it possible to achieve savings in terms of cost price.

According to a complementary feature of the invention, this push-button is fitted with an arresting means preventing the removal of the end link from the clasp cover.

As a result of this other feature, the means of connection between the clasp cover and the second bracelet or belt strand cannot be disassembled unless the link is destroyed. Furthermore, according to a preferred embodiment, the arresting means is removable, which, if necessary, allows the end link or push-button to be replaced when the wristwatch or belt is returned to after-sales service.

Other features and advantages of the present invention will appear more clearly from the following detailed description of an embodiment of the clasp for a watch bracelet or a belt according to the invention, this example being given solely by way of non-limiting illustration with reference to the annexed drawing, in which:

FIG. 3 is a similar view to that of FIG. 2, with the fine adjustment link in the "out" position.

FIG. 4 is a transverse cross-section of the fine adjustment end link according to the invention.

FIG. 5 is a similar view to that of FIG. 4, in which the helical springs have been replaced by a strip spring.

FIG. 6 is a partial perspective view of a belt fitted with the clasp according to the invention.

The present invention proceeds from the general inventive idea which consists in using a spring as an elastic means controlling the uncoupling between a toothed element and a rack toothing of a fine adjustment link of a watch bracelet or a belt clasp. This spring provides a longer travel for the push-button associated therewith, so that the movement of the toothed element controlled by the push-button from its first position, in which it is meshed with the rack toothing, to its second position, in which it is released from its engagement with the rack toothing, is also greater. The teeth of the rack toothing can thus be higher with deeper hollows between the teeth, which ensures improved locking of the toothed element and allows the manufacturing tolerances of the teeth of the rack toothing to be reduced.

The present invention will be described with reference to a watch bracelet. It goes without saying however that this example is given purely by way of non-limiting illustration and that the clasp according to the invention may also be used for a belt.

Figure 2:
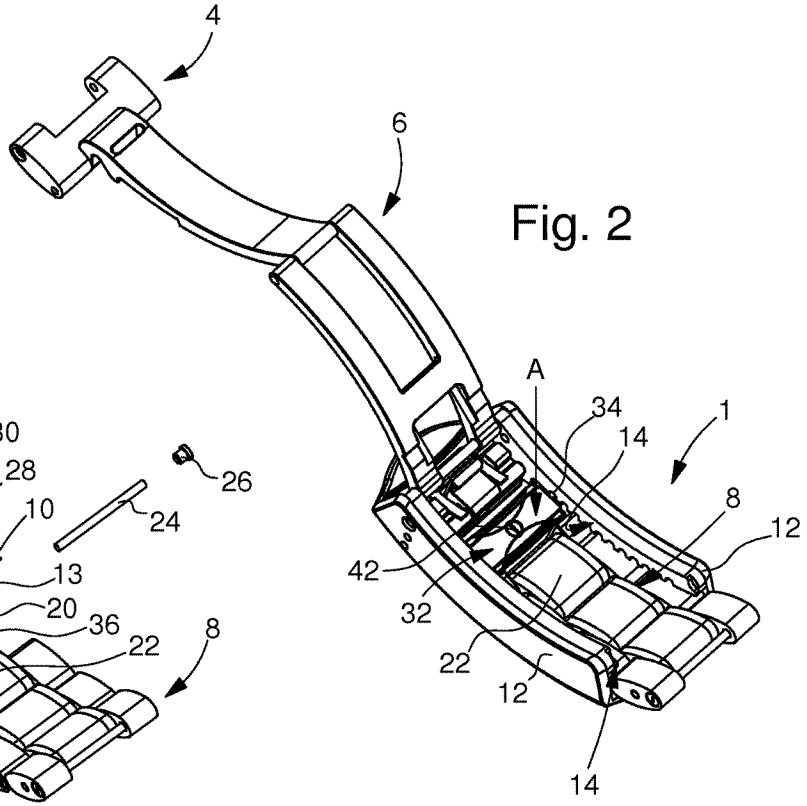
FIG. 2 is a perspective view of the clasp of FIG. 1 in the assembled state, with the fine adjustment end link in the "in" position.
Figure 1:
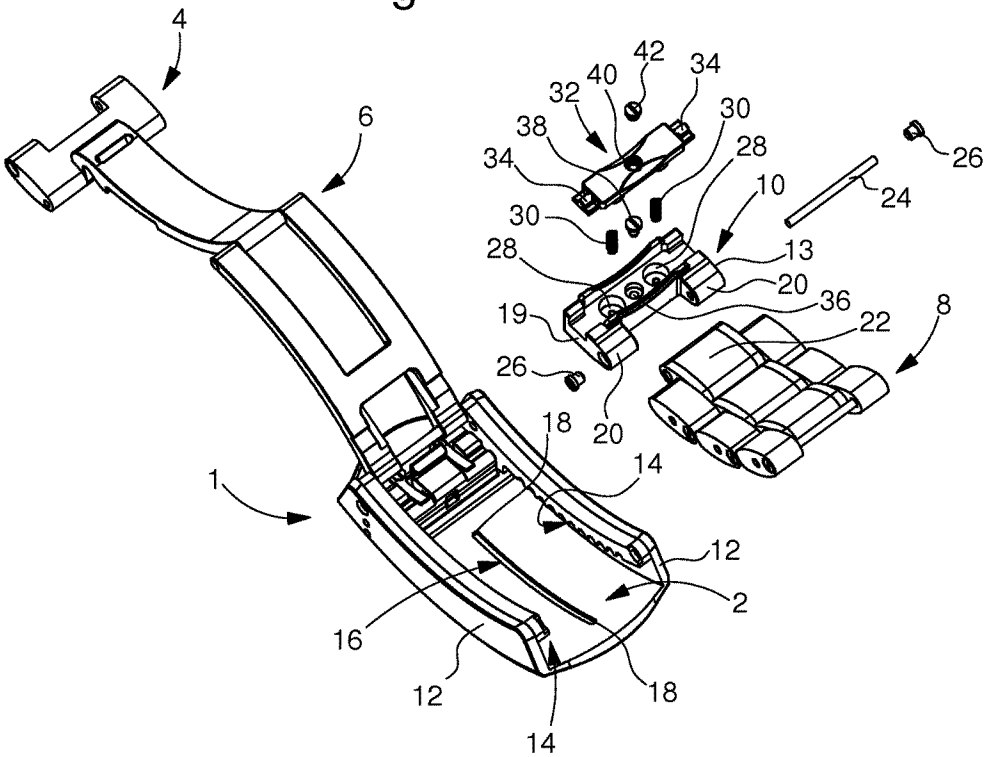
FIG. 1 is a perspective view of the clasp of the invention in an unassembled state.
Figure 7:
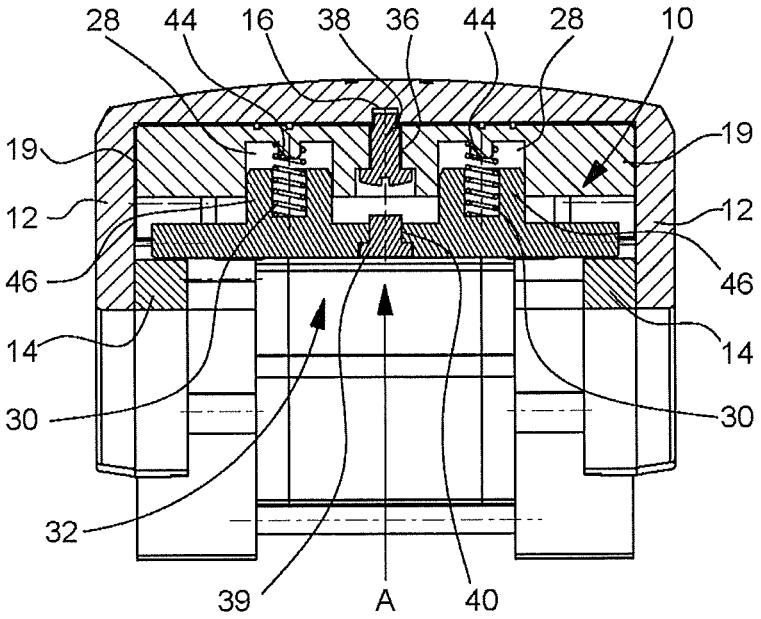
FIG. 7 is a similar view to that of FIG. 4, in which the screw has been replaced by a cap.

FIG. 1 is a perspective view of the clasp of the invention in an unassembled state, while FIG. 2 is a perspective view of the same clasp in the assembled state. Designated as a whole by the general reference numeral 1, the clasp according to the invention includes a cover 2, connected on a first side to a first bracelet strand 4, only one link of which is visible in the drawing, with the insertion of a folding buckle locking system 6, the structure of which is known and will not therefore be described further here. It will be noted that the folding buckle fastening system 6 may be omitted and that cover 2 may be directly connected to the first bracelet strand 4. Cover 2 is connected on a second side to a second bracelet strand 8, only three links of which are visible in the drawing, with the insertion of an end link 10 for the fine adjustment of the watch bracelet length.

As can be seen upon examining FIG. 1, cover 2 has a generally U-shaped section and is provided with two wings 12 which face each other, said wings 12 each carrying a rack toothing 14 on the inward facing surface thereof. Further, a groove 16 is arranged in the bottom of cover 2 and defines two end stop members 18, whose role will be described in detail below. Finally, end link 10 includes lateral guide surfaces 19 for slidably guiding said link inside cover 2 between the bottom of cover 2 and wings 12. It will be appreciated upon comparing FIGS. 2 and 3 that end link 10 is capable of sliding along a longitudinal direction of clasp 1 between a first position (FIG. 2), in which end link 10 is engaged in cover 2 of link 1, and a second position (FIG. 3), in which end link 10 is released from cover 2 of clasp 1. The available length for adjusting the bracelet is determined by the travel of end link 10 between its first and second positions.

End link 10 includes two end knuckles 20 between which the median knuckle 22 of the next link of second bracelet strand 8 nests. The links are assembled to each other by a bar 24 which passes unrestricted through knuckles 20 and 22 and which is held by two end screws 26.

End link 10 includes at least one and preferably two cylindrical blind housings 28 inside each of which there is arranged a helical spring 30, said springs 30 being covered by a push-button 32. Push-button 32 takes substantially the form of a rectilinear actuation bar, which extends transversely to the longitudinal axis of symmetry of clasp 1 and which has a toothed element 34 at each end thereof, for example in the form of a semi-cylinder. These toothed elements 34 are intended to mesh with rack toothing 14. It will be clear that when end link 10 and its push button 32 are made to slide between the two wings 12 inside cover 2 of clasp 1, as illustrated in FIG. 2, the helical springs 30 which are shown compressed, force push-button 32 towards racks 14, so that toothed elements 34 mesh with rack toothings 14. Conversely, when push-button 32 is pressed along arrow A against the elastic return force of springs 30, toothed elements 34 are released from their engagement with rack toothings 14. It will also be understood that helical springs 30 provide push-button 32 and thus toothed elements 34 with a long travel, so that the teeth of rack toothings 14 may be high and the spaces between the teeth deep. Consequently, toothed elements 34 are perfectly locked in rack toothings 14, so that it is impossible to accidentally lose the adjustment of end link 10. Further, the tolerance requirements of rack toothings 14 are lower, which makes savings in terms of production costs possible.

It is also observed upon examining FIGS. 1 and 4 that, between the two blind cylindrical housings 28 arranged in end link 10, there is arranged a first threaded through hole 36 in which there is screwed a screw 38 whose tip projects into groove 16 arranged in the bottom of cover 2. Since this groove 16 is limited at each end thereof by a stop member 18 which marks the bottom of the groove 16, it is quite impossible to disassemble fine adjustment end link 10 once screw 38 has been screwed in. Finally, a second through hole 40 aligned with first threaded through hole 36 is machined in push-button 32. According to a first variant embodiment of the invention, a cap 39 is driven or bonded in second through hole 40 in order to mask screw 38 and conceal the hole from the user's view. In that case however, push-button 32 is permanently impossible to disassemble. According to a second variant embodiment of the invention, a screw 42 is screwed into second through hole 40. This screw 42 conceals screw 38 from the user's view. However, it remains possible to dismantle the assembly given that screw 42 simply has to be taken out in order then to remove screw 38. These two variant embodiments are preferred to the variant providing only one screw which is sufficiently long to be flush with the surface of push-button 32. Indeed, in that embodiment, the screw head would project from push-button 32 when the latter is pressed against the elastic return force of springs 30, which is unattractive.

It will be noted that, at the bottom of blind cylindrical housings 28, two studs 44 are provided for centring springs 30. Further, push-button 32 is provided on the surface thereof facing fine adjustment end link 10 with two cylindrical housings 46 coaxial with blind cylindrical housings 28 for guiding and holding springs 30.

It goes without saying that this invention is not limited to the embodiment that has just been described and that various simple alterations and variants could be envisaged by those skilled in the art without departing from the scope of the invention as defined by the annexed claims.

In particular, as illustrated in FIG. 5, it is possible to envisage replacing the two helical springs 30 with a strip spring 48. In the example shown in the drawing, this strip spring 48 has a V-shaped profile. It is fixed at the centre thereof by means of a screw 50 in the bottom 52 of end link 10 and push-button 32 is elastically supported on the two arms 54 of strip spring 48. The degree of bending of these arms 54 determines the travel of push-button 32 and thus of toothed elements 34. The greater the degree of bending, the longer the travel of the push-button will be and the higher the teeth of rack toothings 14 can be and the deeper the spaces between the teeth. Consequently, toothed elements 34 are perfectly locked in rack toothings 14, so that it is impossible to accidentally lose the adjustment of end link 10. Further, the tolerance requirements of rack toothings 14 are lower, which makes savings in terms of production costs possible. As before, the tip of screw 50 projects into groove 16 arranged in the bottom of cover 4, so that it is quite impossible to disassemble fine adjustment end link 10 once screw 50 has been screwed in. Likewise, as described above, a screw 58 screwed into push-button 32 is aligned with screw 50 to mask screw 50 and to conceal the hole from the user's view.

Likewise, as illustrated in FIG. 6, it goes without saying that the clasp according to the invention may also be used for a belt worn as clothing. In that case, a first end 60 of belt 62 is directly connected to clasp cover 2, whereas the second end 64 of belt 62 is connected to clasp cover 2 with the insertion of a connection means according to the invention which includes end link 10.

The invention claimed is:

1. A clasp for a watch wristlet, bracelet, or belt comprising:

a cover connected on a first side to a first strand of the wristlet, bracelet, or belt and on a second side to a second strand of the wristlet, bracelet, or belt, wherein a connecting mechanism is inserted between the second strand and the cover of the clasp, wherein the connecting mechanism comprises an end link; and a next link connected to said end link, wherein said end link slides along a longitudinal direction of the clasp between a first position in which the next link is at least partially engaged in the cover of the clasp, and a second position in which the next link is disengaged from the cover of the clasp, wherein the end link comprises a push-button which, when pressed, causes a toothed element to change from a first position, in which the toothed element is in mesh with a rack toothing integral with the cover of the clasp, to a second position, in which the toothed element is released from an engagement thereof with the rack toothing;

wherein the end link includes a housing in which there is arranged at least one spring, wherein the spring is covered by the push-button which acts in a perpendicular direction to a plane of the clasp, and wherein the toothed element is carried by the push-button.

2. The clasp according to claim 1, wherein the push-button is provided with an arresting mechanism preventing a removal of the end link from the cover of the clasp.

3. The clasp according to claim 2, wherein the arresting mechanism is removable.

4. A clasp for a watch wristlet, bracelet, or belt comprising:

a cover connected on a first side to a first strand of the wristlet, bracelet, or belt and on a second side to a second strand of the wristlet, bracelet, or belt, wherein a connecting mechanism is inserted between the second strand and the cover of the clasp, wherein the connecting mechanism comprises an end link; and a next link connected to said end link, wherein said end link slides along a longitudinal direction of the clasp between a first position in which the next link is at least partially engaged in the cover of the clasp, and a second position in which the next link is disengaged from the cover of the clasp, wherein the end link comprises a push-button which, when pressed, causes a toothed element to change from a first position, in which the toothed element is in mesh with a rack toothing integral with the cover of the clasp, to a second position, in which the toothed element is released from an engagement thereof with the rack toothing;

wherein the end link includes a housing in which there is arranged at least one spring, wherein the spring is covered by the push-button which acts in a perpendicular direction to a plane of the clasp, wherein the toothed element is carried by the push-button, wherein the push-button is provided with an arresting mechanism preventing a removal of the end link from the cover of the clasp, wherein the arresting mechanism is removable, and wherein the arresting mechanism is formed by a screw which projects into a groove arranged in a bottom of the cover and which defines two end stop members.

5. The clasp according to claim 4, wherein the arresting mechanism is concealed from a user's view.

6. The clasp according to claim 5, wherein the arresting mechanism is concealed by a cap that is driven or bonded thereon.

7. A clasp for a watch wristlet, bracelet, or belt comprising:

a cover connected on a first side to a first strand of the wristlet, bracelet, or belt and on a second side to a second strand of the wristlet, bracelet, or belt, wherein a connecting mechanism is inserted between the second strand and the cover of the clasp, wherein the connecting mechanism comprises an end link; and a next link connected to said end link, wherein said end link slides along a longitudinal direction of the clasp between a first position in which the next link is at least partially engaged in the cover of the clasp, and a second position in which the next link is disengaged from the cover of the clasp, wherein the end link comprises a push-button which, when pressed, causes a toothed element to change from a first position, in which the toothed element is in mesh with a rack toothing integral with the cover of the clasp, to a second position, in which the toothed element is released from an engagement thereof with the rack toothing;

wherein the end link includes a housing in which there is arranged at least one spring, wherein the spring is covered by the push-button which acts in a perpendicular direction to a plane of the clasp, wherein the toothed element is carried by the push-button, wherein the push-button is provided with an arresting mechanism preventing a removal of the end link from the cover of the clasp, wherein the arresting mechanism is concealed from a user's view, and wherein the arresting mechanism is concealed by a screw screwed into a through hole formed on the push-button.

8. The clasp according to claim 1, wherein the cover has a generally U-shaped section and is provided with two wings facing each other, wherein the wings each carry the rack toothing on an inward facing surface thereof.

9. The clasp according to claim 8, wherein the end link includes lateral guide surfaces for slidably guiding the end link inside the cover between the bottom of the cover and the wings.

10. The clasp according to claim 1, wherein the rack toothing extends to a longitudinal end of the cover of the clasp.

11. The clasp according to claim 1, wherein the toothed element is integral with the push-button.

12. The clasp according to claim 1, wherein the first position and the second position of the end link define two opposite end positions of the end link.

13. The clasp according to claim 1, wherein the at least one spring is located between the end link and the push button.

14. The clasp according to claim 1, wherein the next link is disengaged in its entirety from the cover of the clasp in the second position.

* * * * *